United States Patent [19]

Yamamoto et al.

[11] Patent Number: 4,988,252

[45] Date of Patent: Jan. 29, 1991

[54] APPARATUS FOR SUPPLYING PACKAGES TO A WARPER CREEL

[75] Inventors: Yoshio Yamamoto, Kyoto; Isao Nagasawa, Kusatsu, both of Japan

[73] Assignee: Murata Kikai Kabushiki Kaisha, Kyoto, Japan

[21] Appl. No.: 219,051

[22] Filed: Jul. 14, 1988

[30] Foreign Application Priority Data

Jul. 21, 1987 [JP] Japan ..... 62-181936

[51] Int. Cl.[5] ..... B65H 67/00

[52] U.S. Cl. ..... 414/331; 414/564; 414/908; 414/911; 414/736; 414/620; 414/225; 414/282; 414/340; 294/88; 242/35.5 A

[58] Field of Search ..... 414/331, 227, 225, 908, 414/347, 346, 910, 911, 564, 364, 620, 282, 226, 744.8; 198/345, 398, 487.1, 486.1; 242/35.5 A; 294/88; 29/568

[56] References Cited

U.S. PATENT DOCUMENTS

| | | | |
|---|---|---|---|
| 3,773,190 | 11/1973 | Ishida et al. | 414/331 |
| 4,041,686 | 8/1977 | Inaba et al. | 414/227 X |
| 4,226,567 | 10/1980 | Van Orsdale, Jr. | 414/555 |
| 4,505,020 | 3/1985 | Kinoshita | 414/736 X |
| 4,515,328 | 5/1985 | Payne, Jr. | 414/331 X |
| 4,555,215 | 11/1985 | Raasch et al. | 414/331 X |
| 4,654,955 | 4/1987 | Mathie | 414/736 X |
| 4,729,709 | 3/1988 | Raasch | 414/736 X |
| 4,783,021 | 11/1988 | Nagasawa | 414/280 X |
| 4,807,350 | 2/1989 | Kasenkamp | 414/908 X |
| 4,810,155 | 3/1989 | D'Agnola | 414/331 |

*Primary Examiner*—Frank E. Werner

*Attorney, Agent, or Firm*—Spensley Horn Jubas & Lubitz

[57] ABSTRACT

In an apparatus for collectively holding a plurality of packages aligned in a row to supply them to pegs of a creel bogie, an apparatus for supplying packages to a warper creel includes a package holding mechanism and an empty take-up tube holding mechanism.

18 Claims, 9 Drawing Sheets

APPARATUS FOR SUPPLYING PACKAGES TO A WARPER CREEL

FIELD OF THE INVENTION AND RELATED ART STATEMENT

The present invention relates to an apparatus for supplying packages to a warper creel used for a warper.

In a warper used in the process for preparation of warp yarns of a loom, yarns drawn out of a number of feed packages mounted to a warper creel (hereinafter merely referred to as a creel) are wound about a warper drum. Accordingly, on the creel, a large number of packages equal to the number of warp yarns of the loom are supported on vertical planes in all directions with a spacing such that yarns to be released are not interfered from each other. For example, a thousand and hundreds packages are orderly supported on pegs on the creel.

The supply of packages to the creel as described is carried out in a manner such that the packages doffed from a winder in the preceding step are supplied one by one by hands of an operator.

As described above, in the case where the supply of packages is carried out by the operator, a bogie is used depending on the height of the creel; many times of reciprocation is made between a package storing site and the creel; the weight of the packages is 3 to 5 kg; the workability is poor and work involves a danger. Further, the yarn layer of the packages are stained by the operator to deteriorate the quality of yarns.

OBJECT AND SUMMARY OF THE INVENTION

It is an object of the present invention to provide an apparatus for collectively holding a plurality of packages and supplying them to pegs of a creel.

According to an embodiment of the present invention, in an apparatus for collectively holding a plurality of packages aligned in a row to supply them to pegs of a creel bogie, an apparatus for supplying packages to a warper creel includes a package holding mechanism and an empty take-up tube holding mechanism.

DETAILED DESCRIPTION OF PREFERRED EMBODIMENT

The apparatus according to embodiment of the present invention will now be described with reference to the drawings.

Figure 1:
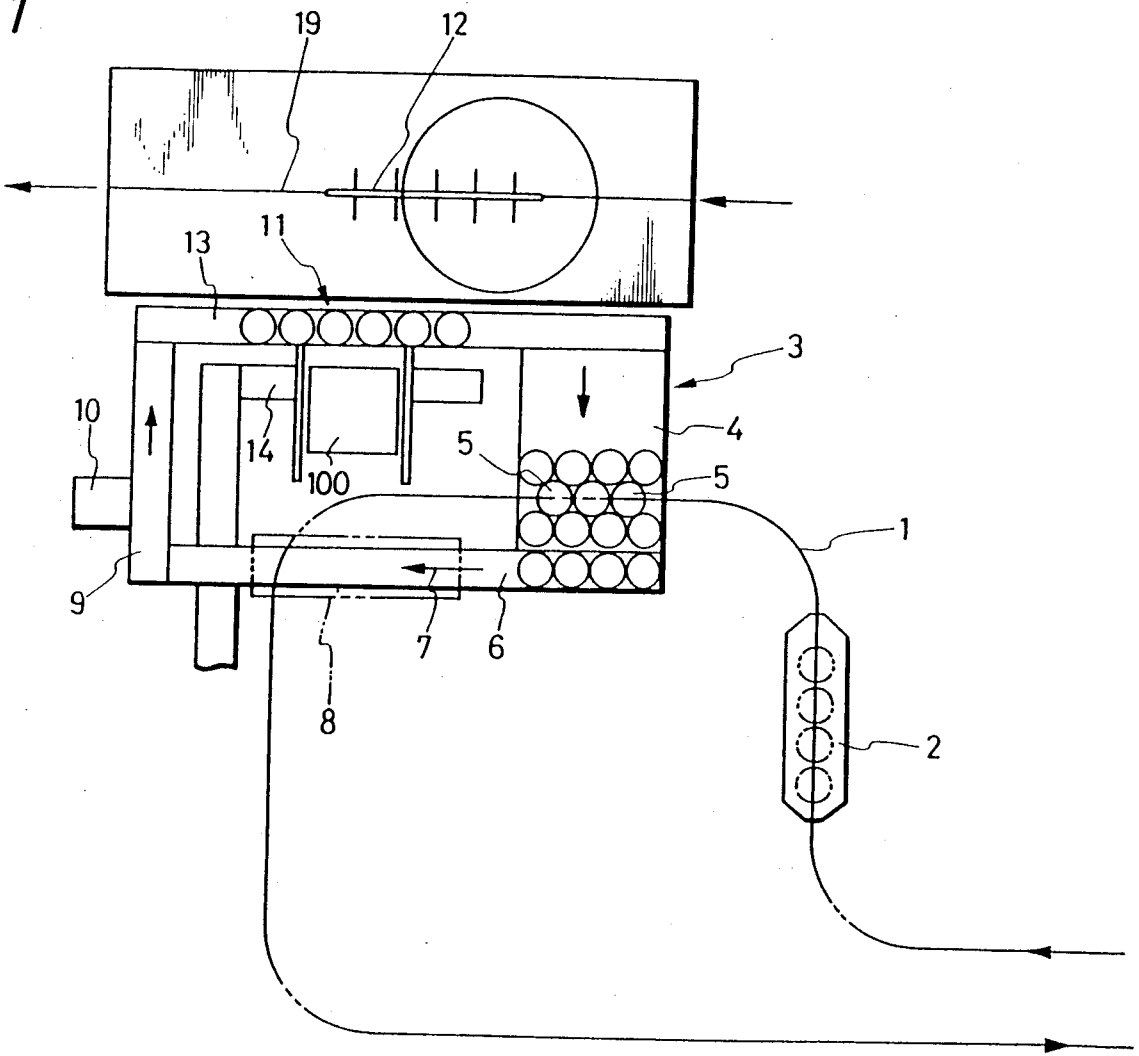
FIG. 1 is a layout view of a package supply system to a warper creel.

FIG. 1 shows a package transporting system applied to the apparatus of an embodiment of the present invention. Packages produced by an automatic winder are suspended in plural and transported by a ceiling self-travel bogie 2 which travels along the ceiling rail 1 and unloaded and transferred onto a tray 5 of a package transporting medium which waits on a conveyor 4 in a package aligning station 3. The packages transferred onto the tray 5 are moved onto a conveyor 6. The packages are then separated one by one and moved in the direction as indicated by arrow 7. In an inspection station 8, a package winding shape, contamination, mixing of different kinds of yarns, weight and the like are checked by the inspection device. Only the packages accepted are moved onto a conveyor 9 to undergo a treatment of a yarn end finding device 10, after which the packages are moved to an aligning position 11 where the required number of packages are aligned in a row. A pitch between the packages at said position is such that the diameter of the tray is set so as to be equal to the peg pitch collectively mounted of the creel bogie 12 or positioning can be made by a stopper used in each tray.

On one side of a conveyor 13 at said aligning position, a creel bogie 12 is arranged, whilst on the other side thereof, a package supply device 100 is arranged. The reference numeral 14 designates a conveyor for ejecting empty take-up tubes on the creel bogie.

Description will now be made of the aforesaid package supply device 100 with reference to FIGS. 2 to 6.

Figure 2:
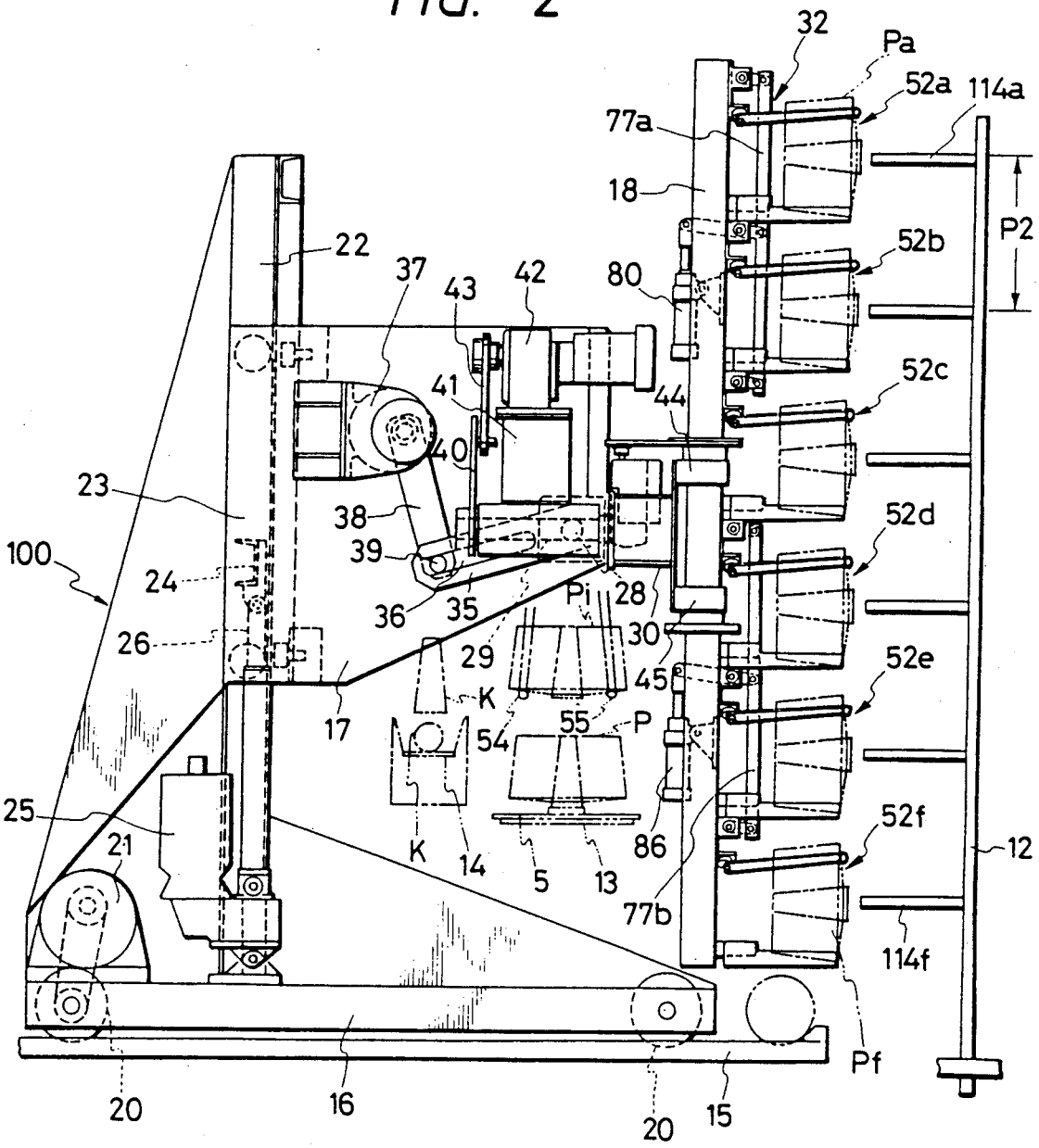
FIG. 2 is a side view showing an apparatus according to an embodiment of the present invention.

FIG. 2 shows the entire structure of the package supply device. The package supply device 100 is composed of a moving bogie 16 movable on rails 15 and 15 arranged perpendicular to the rotating direction of a package transport belt 13 under the latter, a lift 17 provided on the bogie 16, a package transfer arm 18 installed on the lift 17 and the like.

The rails 15 and 15 are laid at right angles to a moving rail 19 of the creel bogie 12 opposed thereto. A bogie 16 is placed on the rails 15 and 15 through a wheel 20, which bogies can be moved in the lateral direction in FIG. 2 by the drive of a motor 21. The bogie is controlled to be stopped at three positions or four positions on the rail 15 by means of a positioning stopping means such as a limit switch or the like.

The aforesaid three positions consist of a most advanced position toward the creel bogie 12, that is, a position to hold an empty take-up tube on the creel bed or a position at which a package is mounted to a peg on the creel, a position at which an empty take-up tube is transferred onto the transporting conveyor 14, and a position to hold a package on the conveyor 13. It is noted that the bogie can be stopped for inversion of the arm in an intermediate position between the conveyor 13 and the creel bogie 12.

A vertically movable lift 17 is provided along the rail 22 constituting a vertical frame of the bogie 16. The lift 17 is moved up and down by an arrangement that a retractable rod 26 of a power cylinder 25 is connected to a cross beam 24 extended between frames 23 and 23.

Between the frames 23 and 23 constituting the lift 17 are fixedly mounted first shafts 28 and 28 divided to both side walls of a housing 27. A second shaft 29 extends through and is supported on the housing 27, the second shaft 29 being rotatable within the housing 27. A package holding arm 18 is supported on the end of the second shaft 29 through a bracket 30.

Further, the arm 18 is composed of an angle having a ]-shape cross-section. A package holding mechanism 32 and an empty take-up tube holding mechanism 34 are provided on one side 31 and the other side 33, respectively, of said arm 18. The holding mechanisms 32 and 34 are selectively moved to the operating position by the 90° rotation of the arm 18.

Accordingly, for example, in FIG. 2, the arm 18 pivots in a direction perpendicular to paper surface by the rotation of the second shaft 29 and pivots within the surface parallel to the paper surface by the rotation of the first shaft 28.

Figure 3:
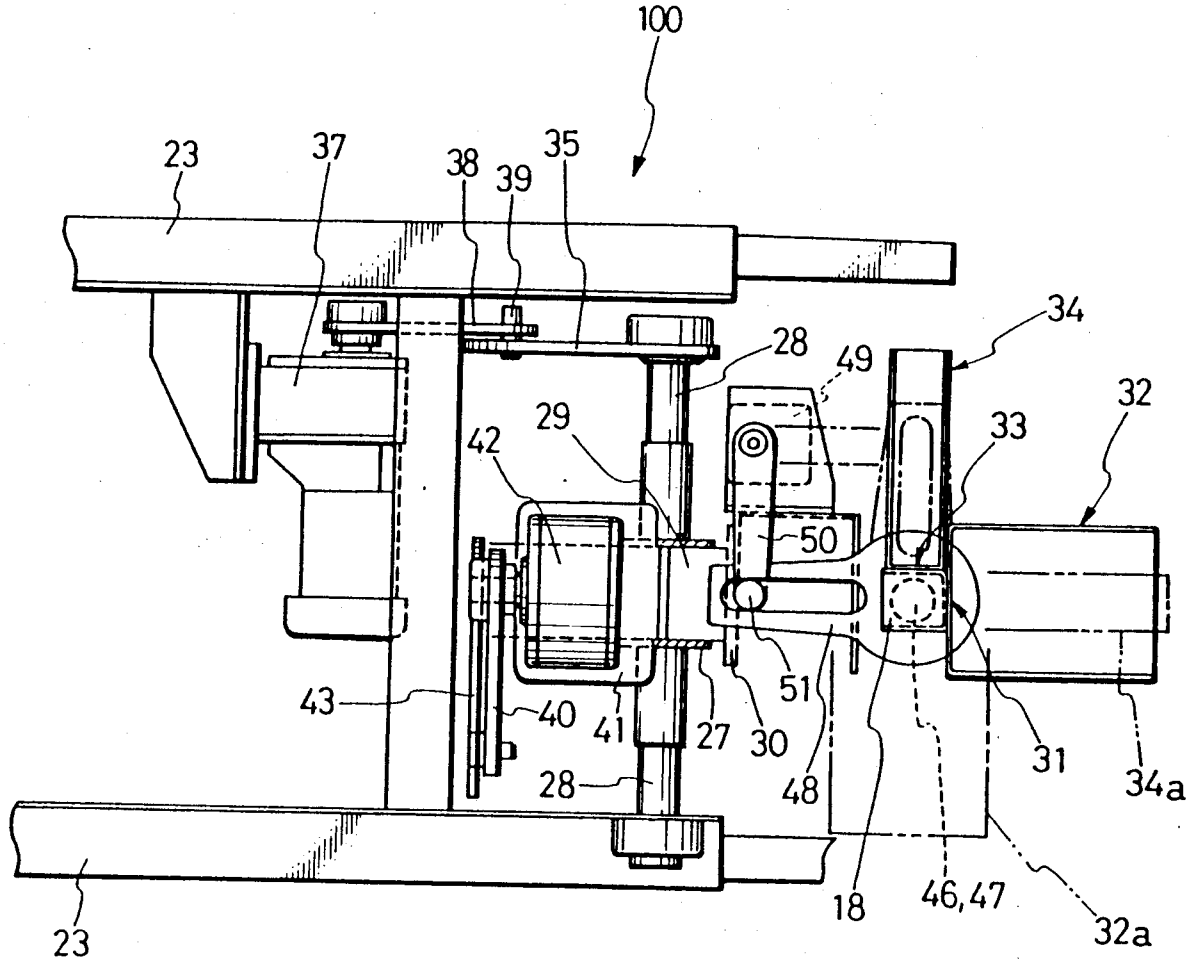
FIG. 3 is a plan view of an arm revolving device of the apparatus of the FIG. 2 embodiment.

In FIGS. 2 and 3, a lever 35 is secured to one end of the first shaft 28, and a pin 39 at the end of a lever 38 on the side of a motor 37 integrally supported on the frame 17 of the lift is slidably loosely fitted in a long groove 36 formed in the lever 35, whereby following the pivoting of the lever 38 in the range of fixed angle the lever 35 pivots at a constant angle about the shaft 28, and the housing 27 secured to the shaft 28 normally and reversely rotates within the paper surface of FIG. 2. The rotational angle of the housing 27 is 90°.

A lever 40 with a slot similar to the aforesaid lever 35 is secured to the rear end of the second shaft 29. The lever 40 is driven by a motor 42 mounted on a bracket 41 integral with the housing 27 and a lever 43. The pivotal range of the lever 40 is set to 90° similar to the lever 35 of the first shaft. Accordingly, the arm 18 secured to the end of the second shaft 29 normally and reversely rotates by 90° perpendicular to the paper surface in FIG. 5 by the rotation of the shaft 29. That is, the arm 18 can assume a position at which the lengthwise direction is parallel to the transport surface of the conveyor 13 in FIG. 2 and a position indicated by the solid line of FIG. 2, that is, a position at right angle to the conveyor surface.

Figure 6:
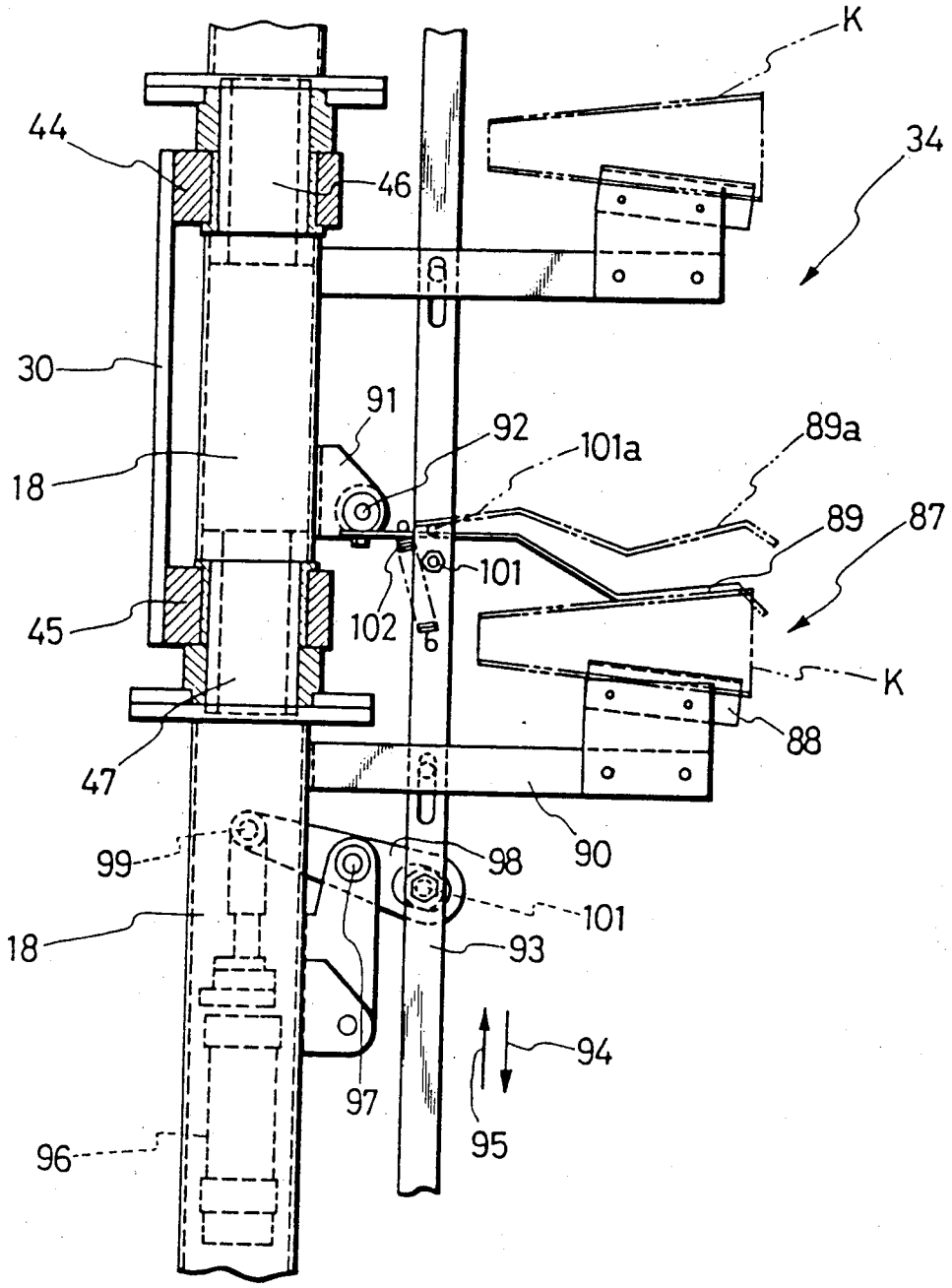
FIG. 6 is a side view of an empty take-up tube holding mechanism.

In FIG. 6, bearings 44 and 45 are supported on the bracket 30 integral with the second shaft 29, and a part of the arm 18 is supported by shafts 46 and 47 having a circular cross-section, said circular portion being supported by the bearings 44 and 45, the other arm portion 18 being an angle having a ]-shape as described above. A lever with a slot 48 is secured to a part of the arm 18 as shown in FIG. 3, and a pin 51 of a lever 50 which pivots by 90° by a motor 49 on the bracket 30 is loosely fitted in the groove 48 of the lever. Accordingly, in the state of FIG. 3, the package holding mechanism 32 is positioned at the front surface, that is, at the operating position, however by the pivoting of the lever 48 through 90° counterclockwise, the arm 18 rotates by 90° clockwise about the shafts 46 and 47, and the empty take-up tube holding mechanism 34 moves to the operating position 34*a*. Description will now be made of the package holding mechanism 32 and the empty take-up tube holding mechanism 34 provided on the arm 18.

(i) Package holding mechanism

Figure 4:
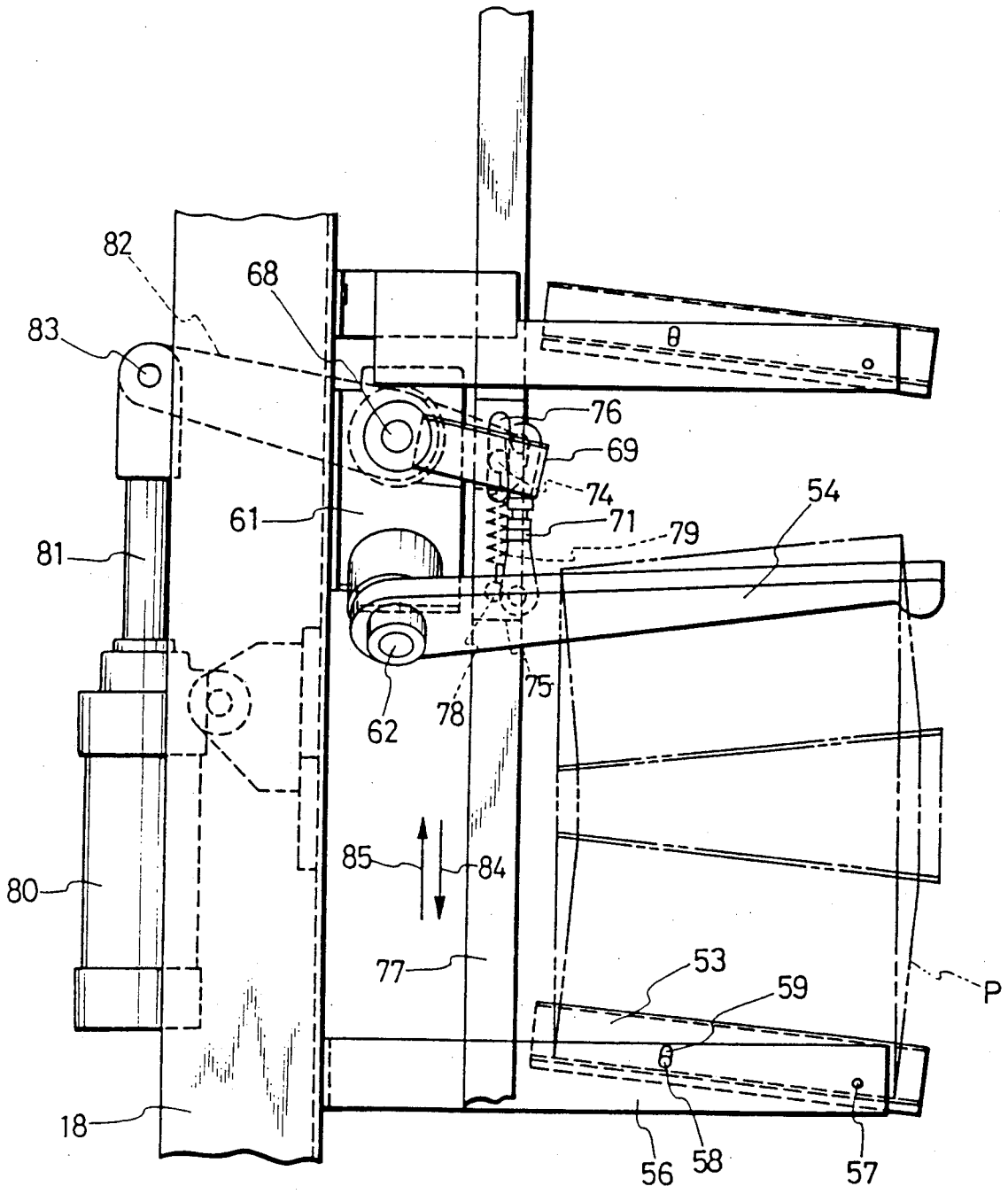
FIG. 4 is a side view of a package holding mechanism.
Figure 5:
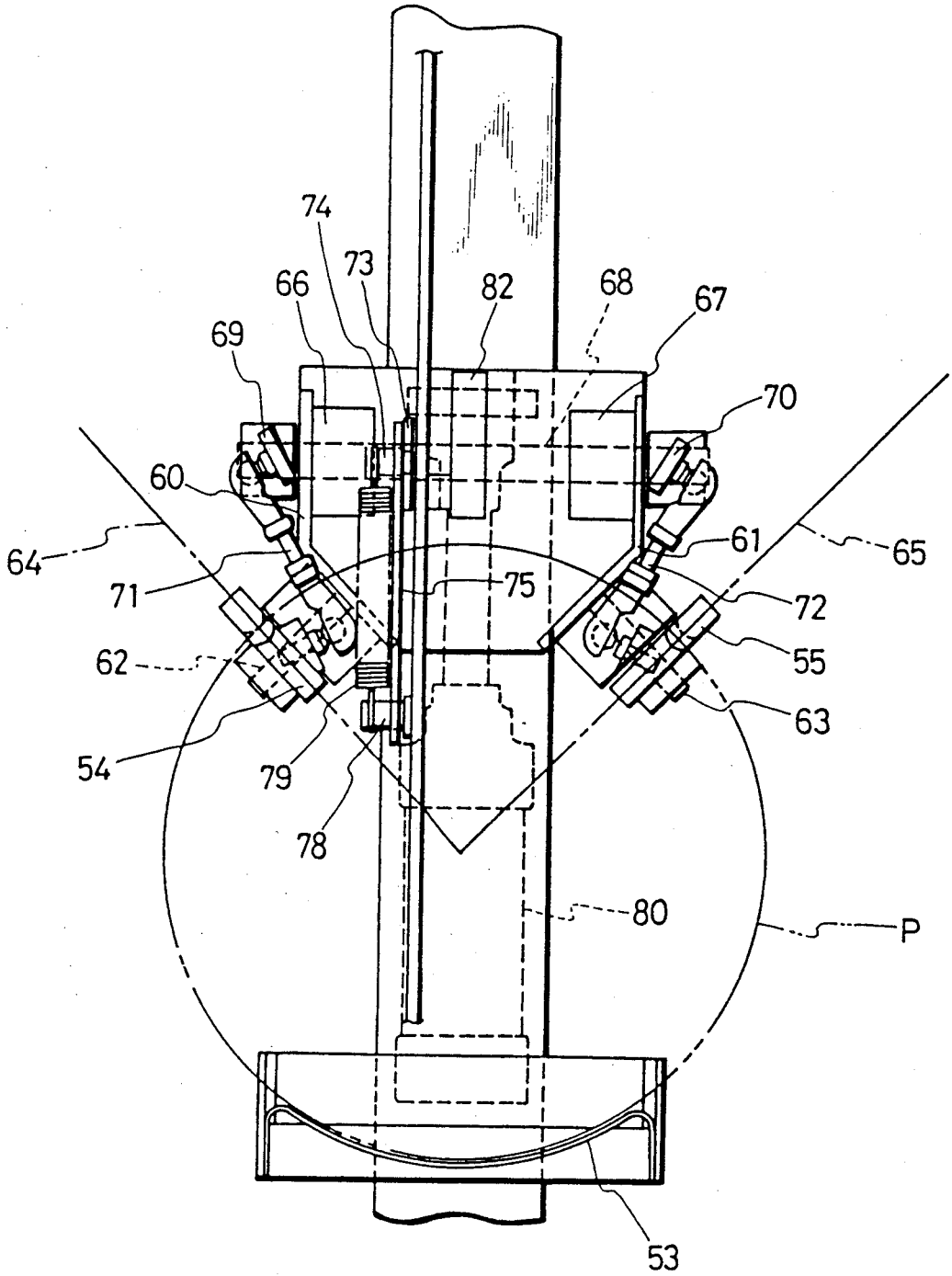
FIG. 5 is a front view of the same.

In FIGS. 2, 4 and 5, in the present embodiment, package holding members 52 are provided at six locations of the arm 18 for collectively transferring six packages from the conveyor to the creel bogie. That is, as shown in FIG. 2, package holding members 52*a*–52*c*, 52*d*–52*f* are provided three in number on either side with the center lengthwise of the arm 18 as the border. Since all the holding members have the same construction, the holding member 52*b* as the typical one will be described with reference to FIGS. 4 and 5.

More specifically, the holding member 52 is composed of a receiving element 53 secured to the arm 18 for supporting the outer peripheral surface of the yarn layer of the package over the given range and a pair of movable chucks 54 and 55 for pressing and holding two positions in the outer periphery of the package P on the receiving element. Accordingly, the package is supported at three locations in the periphery thereof.

The receiving element 53 is formed from a curved plate 53 after the outer peripheral curved surface of the package on the bracket 56 secured to the arm 18, and secured by pins 57 and 58 to both sides of the bracket 56. The pin 58 is fitted into a slot 59 of the bracket 56 so that an angle of inclination of the receiving element 53 may be adjusted.

On the other hand, the movable chucks 54 and 55 are supported on shafts 62 and 63 on brackets 60 and 61 secured to the arm 18 so that the chucks may pivot freely within planes 64 and 65 vertical to the paper surface of FIG. 5. The chucks 54 and 55 are connected through rods 71 and 72 to levers 69 and 70 on both sides of a shaft 68 supported on bearings 66 and 67, and opened and closed by normal and reverse rotations of a shaft 68.

A lever 73 is secured to the shaft 68, and a pin 74 secured to the lever 73 is loosely fitted into a slot 76 of a connecting plate 75, the plate 75 being pinned at 78 to an operating rod 77 extending through a plurality of chuck locations. A spring 79 is extended between the pins 74 and 78. One end of a lever 82 pivotable around the shaft 68 is connected at 83 to the end of a piston rod 81 of a fluid cylinder 80, the lever 82 having the other end pinned at 74 to the operating rod 77.

Accordingly, in FIG. 4, when the operating rod 77 is slidably moved in a direction of arrow 84, the plate 75 on the operating rod 77 integrally moves, and the lever 73 secured to the shaft 68 pivots following the force of the spring 79 to close the chucks 54 and 55.

At that time, as shown in FIG. 4, the pin 74 on the lever 75 which pivots integral with the chuck 54 is in an intermediate position within the slot 76, and thus the chuck 54 is urged against the outer peripheral surface of the package by the spring force.

Conversely, when the operating rod 77 is slidably moved in a direction of arrow 85, the lever 73 integral with the spring 79 pivots counterclockwise about the shaft 68, and therefore the chuck 54 opens.

Such chuck members 52 are provided lengthwise of the arm 18 with a pitch equal to a pitch P2 between pegs 86 on the side of the creel bogie 12.

The operating rod 77 for opening and closing the chuck is divided into two sections 77*a* and 77*b* as shown in FIG. 2, and fluid cylinders 80 and 86 for driving the operating rod are separately disposed. It is of course noted that one operating rod may be provided so that all the chucks may be operated by a single fluid cylinder. However, this increase the size of the fluid cylinder, and therefore, in the present embodiment, the rod is divided into two sections. The operation of the fluid cylinders 80 and 86 are controlled so that the opening and closing timing of the chucks may be synchronized with all the chucks.

(ii) Empty take-up tube holding mechanism

Next, the empty take-up tube holding mechanism will be described with reference to FIG. 6. The empty take-up tube holding member 87 is mounted lengthwise of the arm 18 at a spacing equal to a pitch between the pegs of the creel bogie similar to the aforesaid package holding mechanism, and comprises a fixed empty take-up tube receiving element 88 and a movable chuck 89, the receiving element 88 being formed from a curved plate after the outer peripheral surface of the empty take-up tube and secured to a support member 90 secured to the arm 18. The movable chuck 89 freely pivots around a shaft 92 of a bracket 91 secured to the arm 18, the chuck 89 having its end formed into a bifurcate shape.

The operation of the chuck 89 is effected by the sliding movement of an operating rod 93 in directions of arrows 94 and 95, the rod 93 extending through all the chucks (six in the present embodiment). That is, a part of the operating rod 93 is pinned at 99 to a lever 98 pivotable around a shaft 97 by a fluid cylinder 96 on the side of the arm 18, and a pin 101 for pressing the chuck 89 is secured to the position of each chuck of the operating rod 93. A spring 102 is extended between the chuck 89 and the operating rod 93 to bias the chuck 89 clockwise.

Accordingly, when the operating rod 93 is slidably moved in a direction of arrow 95, the pin 101 presses the chuck 89, and the chuck 89 pivots to a position 89*a* indicated by the dash-dotted contour lines to open the chuck. Conversely, when the operating rod 93 is slidably moved in a direction of arrow 94, the chuck 89 is closed by the spring (102) force to hold an empty take-up tube K between the receiving element 88.

(iii) Creel bogie

Next, the creel bogie 12, the pitch feed of the bogie and the inversion device will be described with reference to FIGS. 7 to 11.

Figure 7:
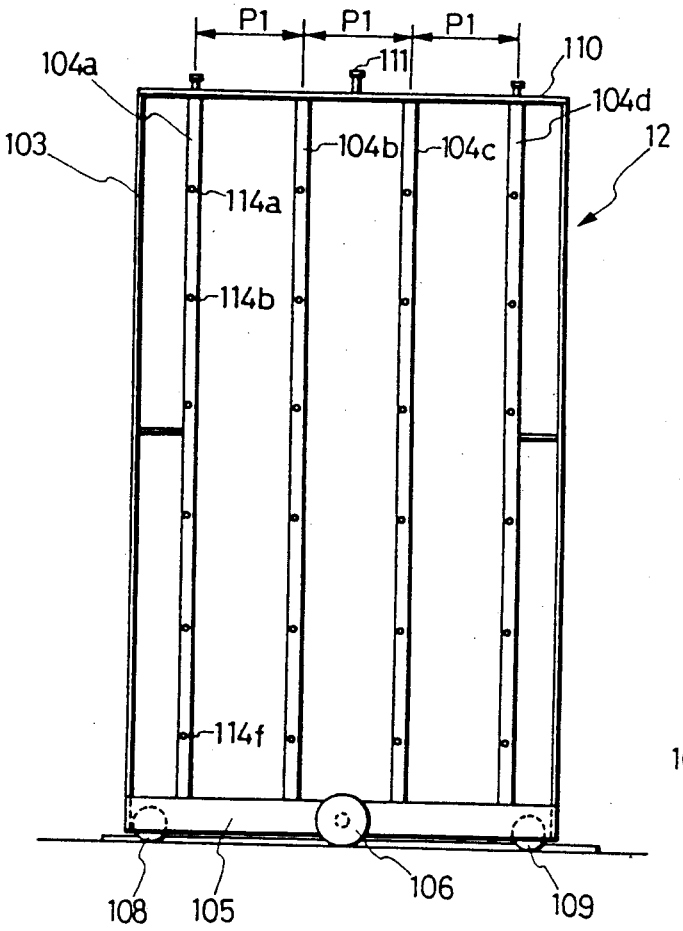
FIG. 7 is a front view showing one example of a creel bogie.
Figure 8:
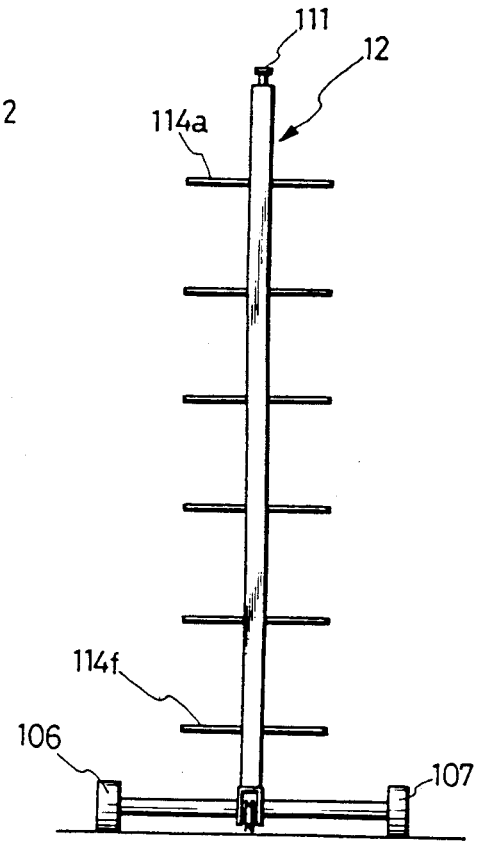
FIG. 8 is a side view of the creel bogie shown in FIG. 7.
Figure 9:
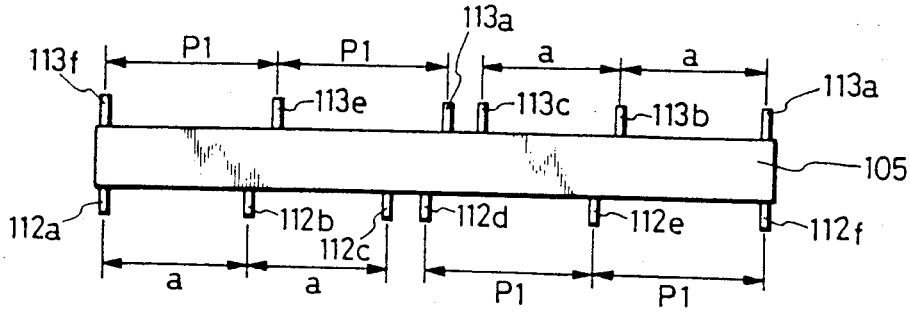
FIG. 9 is a plan view showing a pitch of a pin on a lower frame.

FIGS. 7 to 9 show one example of the creel bogie 12. In this bogie, vertical frames 104*a* to 104*d* are installed at intervals of equal pitch on a frame body 103 composed of upper and lower and both side frames, and pegs 104 are provided at intervals of equal pitch P2 in a vertical direction in each vertical frame. The peg 104 is longer than the length of a take-up tube of a package. In a lower frame 105 of the creel bogie 102, guide rollers 106 and 107 are supported on both sides in the central portion as shown in Figs. 7 and 8, guide wheels 108 and 109 are supported at front and rear ends of the frame 105, and wheels 108 and 109 moves on the guide rail 19 of the package supplying station. A guide roller 111 rolled along the ceiling guide rail not shown is provided on an upper frame 110 of the creel bogie.

Further, pins 112*a* , 112*b* and 112*c* of pitch (a) and pins 112*d*, 112*e* and 112*f* of pitch Pl are horizontally secured to one side of the lower frame 105 of the creel bogie as shown in FIG. 9, and pins 113*a*, 113*b* and 113*c* of pitch (a) and pins 113*d*, 113*e* and 113*f* of pitch P1 are symmetrically secured to the other side of the frame 105. It is noted that the pitch P1 of FIG. 9 is equal to the pitch Pl between the vertical frames of FIG. 7, and the relationship of Pl > a is established.

Figure 10:
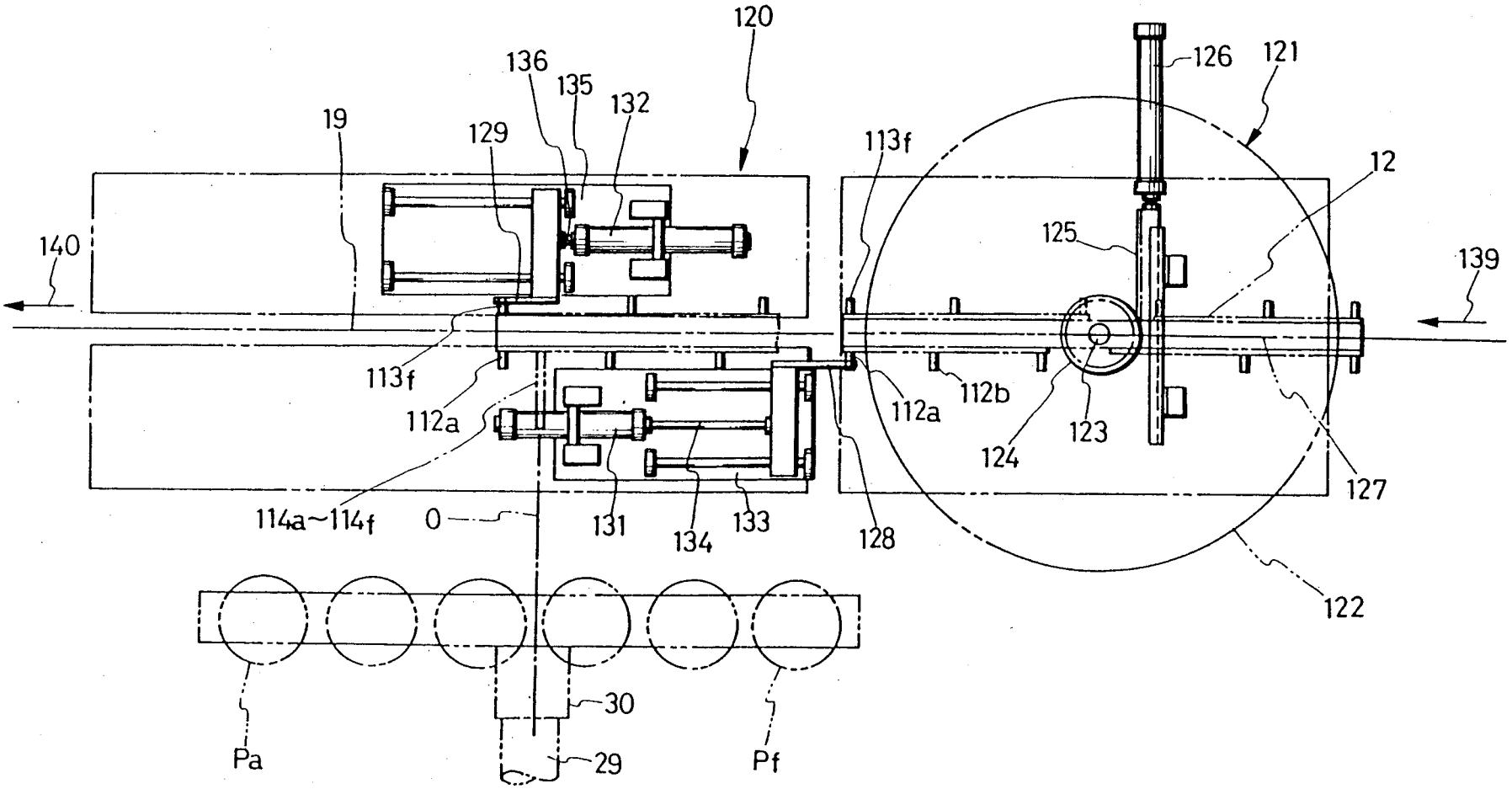
FIG. 10 is a plan view of a pitch feed and inversion device of a creel bogie.
Figures 11, 12:
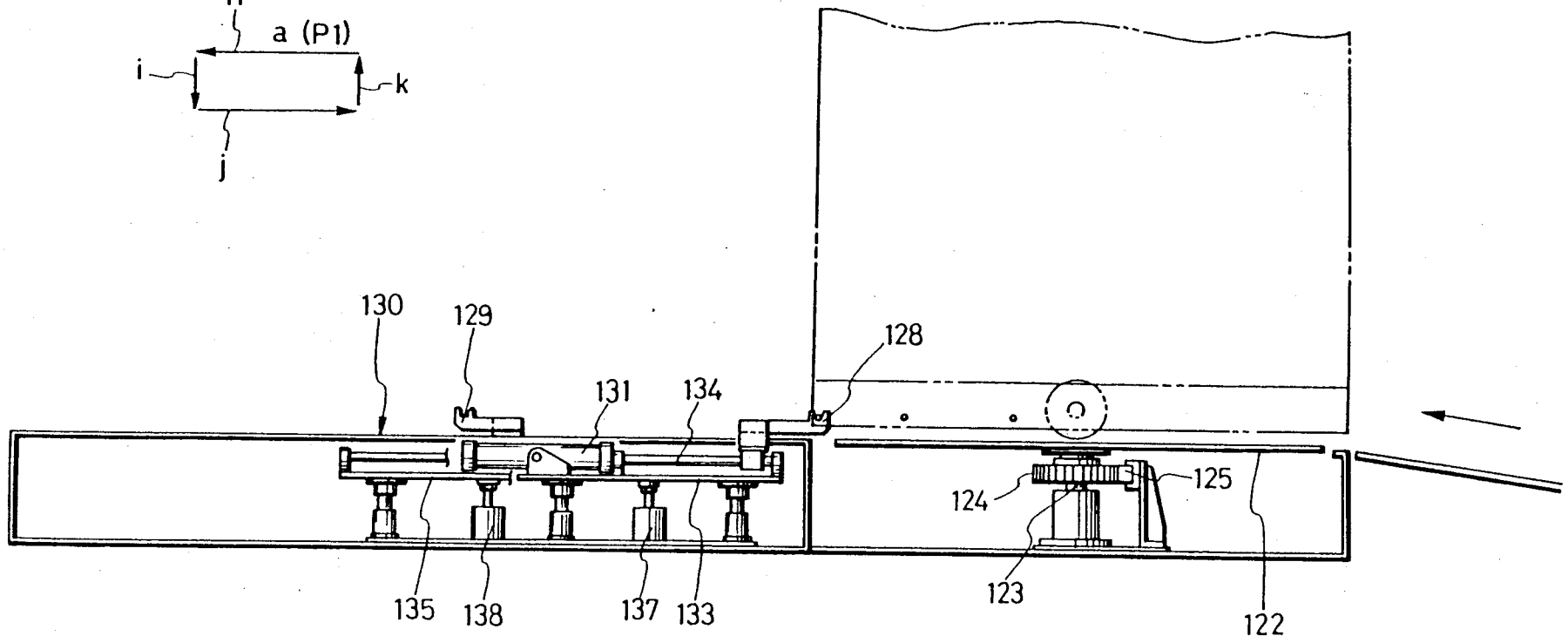
FIG. 11 is a front view of the same.
FIG. 12 is an explanatory view showing motion of a hook.

FIGS. 10 and 11 show the pitch feed 120 of the creel bogie and the inversion device 121. The inversion device 121 is composed of a rotational disc 122, a pinion 124 secured to a shaft 123 of the disc 122 and a rack 125 slidably moved by a fluid cylinder 126. A rail 127 for a creel bogie is secured to the diameter of the disc 122.

The pitch feed device 120 of the creel bogie provided continuous to the inversion device 121 has hooks 128 and 129 which are engaged with and disengaged from the pins 112*a* to 113*f* of the creel bogie and which are moved up and down and slidably moved in the travel direction of the creel bogie. That is, a pair of fluid cylinders 131 and 132 are positioned under the platform 130 on both sides the rail 19 for the creel bogie on the platform 130, one cylinder 131 being installed on a lift bed 133, and a top-open hook 128 acting on the pins 112*a* to 112*c* on one side of the creel bogie is secured to the end of a piston rod 134 of the cylinder. The other cylinder 132 is likewise installed on a lift bed 135 separately from the lift bed 133, and a hook 129 acting on the pins 113*f* to 113*d* on the other side of the creel bogie is secured to the end of a piston rod 136. The upward and downward movement of the lift beds 133 and 135 can be driven by fluid cylinders 137 and 138 which moves forward and backward in a vertical direction in FIG. 11.

The platform 130 formed from a plate such as an iron plate is provided above the cylinders 137 and 138, the creel bogie is supported and rotated by rollers (FIG. 8, 106 and 107), and a space is formed in a slide region portion of the hooks 128 and 129.

Accordingly, the creel bogie 12 having been moved in the direction of arrow 139 in FIG. 10 once stops at a position indicated by the dash-dotted contour line on the rotational disc 122, and then, the hook 128 of the cylinder 131 comes to engagement with the pin 112*a* of the bogie and slides at (h) leftward through one pitch (a) as in FIG. 12. When the hook moves down (i), moves rightward (j) and moves upward (k), the hook again comes to engagement with the next pin 112*b* to move. the bogie through the pitch (a). In this manner, when the cylinder 131 takes three reciprocations, the pin 113*f* on the left end of the creel bogie is positioned to a position where the pin 113*f* engages the hook 129 of the other cylinder 132 and the pegs 114*a* to 114*f* on the vertical frame (FIG. 7, 104*a*) on the left end of the creel bogie come into registration with the center (0) of the arm of the package supply device. At this position, the six packages Pa to Pf are all at once supplied to the pegs 114*a* to 114*f*.

Next, by the leftward movement of the hook 129 through 1 pitch Pl, the next vertical frame 104*b* of the creel bogie is positioned to the supply position, and three reciprocations of the cylinder 132 causes the packages to be supplied to all the pegs on the four-row vertical frames 104*a* to 104*d* as shown in FIG. 7.

Subsequently, by the operation reversed to the aforementioned operation, that is, three reversed reciprocations of the hook 129 and three reversed reciprocations of the other hook 128, the creel bogie returns to a fixed position (position in FIG. 10) on the rotational disc 122, and the hook 128 is disengaged from the pin 112*a*. When the rotational disc 122 is rotated through 180° , the empty peg is directed toward the package supply device. The operation similar to the above is again repeated to supply the packages to all the pegs on both sides of the creel bogie. The fully loaded creel bogie is delivered toward the arrow 140, and the next creel bogie is again taken in.

Description will now be made of the operation of the aforesaid package supply device.

In FIG. 1, in the case of the creel bogie wherein the creel bogie carried onto the platform has completed work with a warper, each peg has an empty take-up tube or a take-up tube with a residual yarn mounted thereto. First, when the vertical frame 104*a* on the left end of the creel bogie is positioned so as to coincide with the center position 0 of the supply device 100 as shown in FIG. 10, the empty take-up tube holding device 34 is first driven by the motor 49 in FIG. 3 so that the device 34 is directed toward the creel as shown in FIG. 6, and the arm 48 rotates through 90° around the shaft 46 and the chuck 89 is directed toward the creel. Next, the bogie 19 in FIG. 2 moves rightward while the arm 18 is in its vertical state and moves to a position where the empty take-up tube of the creel is held by the receiving element 88 in FIG. 6 and the chuck 89. The arm stops at the most advanced position of the bogie, after which the cylinder 96 in FIG. 6 is operated and the operating rod 93 is slidably moved in a direction of arrow 94 whereby all the chucks 89 simultaneously pivot from the dash-dotted contour line position 89*a* to the solid line position, and the empty take-up tube K is held by the gripping force of the spring 102 force.

Next, when the bogie moves backward and the empty take-up tube is removed from the peg on the creel, the motor 42 in FIG. 2 is driven, and the arm 18 rotates through 90° around the second shaft 29 and pivots from the vertical position to the horizontal position. In this state, the axis of the empty take-up tube is still in the same direction as the peg of the creel, that is, approximately in a horizontal direction. At that time, the lift bed 17 is moved along the rail 22 to the uppermost position.

Then, by the rotation of the first shaft 28 clockwise in FIG. 2 through 90° by the drive of the motor 37, the arm 18 pivots through 90° around the second shaft, and the empty take-up tube moves to the vertical position. When the bogie further moves leftward and moves to the position where the empty take-up tube assumes a position on the conveyor 14, the lift body 17 moves down a fixed distance as the bogie stops. When the holding of the chuck is released, six empty take-up tubes simultaneously falls onto the conveyor 14.

When the empty take-up tube has been removed, the arm 48 in FIG. 3 again rotates counterclockwise through 90° around the shaft 46 to direct the package holding member toward the conveyor 13 in FIG. 2, and the bogie moves to the position of the package P on the tray 5 aligned on the conveyor 13. The bogie moves down in the state wherein the chucks (FIG. 5, 54 and 55) are opened by the downward movement of the lift body 17, and the lift body moves down through a fixed stroke, after which the chucks 54 and 55 are closed to hold the packages on the trays.

Next, when the package moves up to the dashdotted contour line position Pi in FIG. 2, the arm 18 pivots counterclockwise around the first shaft 28.

By the further rotation of the arm 18 through 90° around the second shaft 29, six packages are positioned to positions opposed to the pegs 114*a* to 114*f* of the creel as shown in FIG. 2.

Then, when the bogie moves rightward and the packages Pa to Pf are inserted into the pegs 114*a* to 114*f*, the fluid cylinders 80 and 86 are operated to open the chucks 54 and 55, and the lift body 17 somewhat moves down whereby the packages are transferred to the pegs to separate the package P from the receiving element 53.

In this manner, when the empty take-up tubes in one row of the vertical frame of the creel bogie are taken out and the supply of the packages are completed, the creel is fed through 1 pitch Pl by the pitch feed device 120, and the supply of packages to the next vertical frame is carried out.

The supply of packages to the single creel bogie is carried out in the procedure described above.

While in the above-described embodiments, the creel bogie is a mere example and the arrangement of the pegs is the same with respect to each vertical frame as in FIGS. 7 and 8, it is to be noted that even if the peg position of the adjacent vertical frames is deviated by half pitch and are arranged in a zigzag fashion, the above-described package supply device can be applied, that is, the positioning of the lift body 17 can be made to follow the arrangement of the pegs. Accordingly, the creel bogie is not limited to those shown in an embodiment of the drawings.

As described above, in the present invention, the package supply device to the creel bogie has an empty take-up tube holding mechanism and a package holding mechanism, and therefore, in the case where the peg on the creel is longer than the length of the take-up tube and even in the case where a chuck cannot be moved into a center hole of the take-up tube, the package can be replaced.

What is claimed is:

1. An apparatus for supplying a plurality of packages to and receiving a plurality of take-up tubes from pegs of a creel bogie, the apparatus comprising:

a movable bogie;

means for moving the movable bogie;

a lift supported by the bogie;

lift moving means for moving the lift with respect to the bogie;

a package transfer arm supported by the lift, said package transfer arm having a first side and a second side, the second side being arranged substantially 90° with respect to the first side;

a package holding mechanism provided on the first side of the package transfer arm, the package holding mechanism having package supplying means for supporting a plurality of packages and for simultaneously supplying the plurality of packages to a corresponding plurality of pegs of the creel bogie at a first time;

an empty take-up tube holding mechanism provided on the second side of the package transfer arm, the empty take-up tube mechanism having empty take-up tube receiving means for simultaneously receiving a plurality of empty take-up tubes from a corresponding plurality of pegs of the creel bogie at a second time, the second time being a different time than the first time; and means for rotating the package transfer arm at least substantially 90°.

2. The apparatus as claimed in claim 1, wherein said lift comprises a movable member which is moved up and down by a power cylinder along a second rail constituting a vertical frame of the bogie.

3. The apparatus as claimed in claim 1, wherein the package holding mechanism includes a plurality of chuck members, each chuck member comprising a receiving element secured to the package transfer arm for supporting an outer peripheral surface of a yarn layer of a package and a pair of movable chucks for pressing and holding the outer periphery of the package, said receiving element being formed from a curved plate.

4. An apparatus for supplying a plurality of packages to and receiving a plurality of take-up tubes from pegs of a creel bogie, the apparatus comprising:

a movable bogie;

means for moving the movable bogie;

a lift supported by the bogie;

lift moving means for moving the lift with respect to the bogie;

a package transfer arm supported by the lift, said package transfer arm having a first side and a second side, the second side being arranged substantially 90° with respect to the first side;

a package holding mechanism provided on the first side of the package transfer arm, the package holding mechanism having package supplying means for supporting a plurality of packages and for simultaneously supplying the plurality of packages to a corresponding plurality of pegs of the creel bogie at a first time;

empty take-up tube holding mechanism provided on the second side of the package transfer arm, the empty take-up holding mechanism having empty take-up tube receiving means for simultaneously receiving a plurality of empty take-up tubes from a corresponding plurality of pegs of the creel bogie at a second time, the second time being a different time than the first time;

means for rotating the package transfer arm at least substantially 90°;

a package transport belt;

a transporting conveyor; and a positioning stopping means for the movable bogie provided to stop the bogie at any of three positions comprising a most advanced position toward the creel bogie to hold an empty take-up tube supported by a peg of the creek bogie or to mount a package to a peg on the creel bogie, a position at which an empty take-up is transferred onto the transporting conveyor, and a position to hold a package on the package transport belt.

5. An apparatus for supplying a plurality of packages to and receiving a plurality of take-up tubes from pegs of a creel bogie, the apparatus comprising:

a movable bogie;

means for moving the movable bogie;

a lift supported by the bogie;

lift moving means for moving the lift with respect to the bogie;

a package transfer arm supported by the lift, said package transfer arm having a first side and a second side, the second side being arranged substantially 90° with respect to the first side;

a package holding mechanism provided on the first side of the package transfer arm, the package holding mechanism having package supplying means for supporting a plurality of packages and for simultaneously supplying the plurality of packages to a corresponding plurality of pegs of the creel bogie at a first time;

an empty take-up tube holding mechanism provided on the second side of the package transfer arm, the empty take-up tube holding mechanism having empty take-up tube receiving means for simultaneously receiving a plurality of empty take-up from a corresponding plurality of pegs of the creel bogie at a second time, the second time being a different time than the first time;

means for rotating the package transfer arm at least substantially 90°;

wherein said lift comprises a movable member which is moved up and down by a power cylinder along a second rail constituting a vertical frame of the bogie;

wherein a supporting means for supporting the package transfer arm on the lift includes a first shaft which is mounted between the frames of the lift and is divided by both sides walls of a housing interposed therebetween, and a second shaft which extends through and is supported on and being rotatable in the housing, said second shaft supporting the package transfer arm on one end thereof so that the package transfer arm pivots by the rotation of the first and second shafts, respectively.

6. An apparatus for supplying a plurality of packages to and receiving a plurality of take-up tubes from pegs of a creel bogie, the apparatus comprising:

a movable bogie;

means for moving the movable bogie;

a lift supported by the bogie;

lift moving means for moving the lift with respect to the bogie;

a package transfer arm supported by the lift, said package transfer arm having a first side and a second side, the second side being arranged substantially 90° with respect to the first side;

a package holding mechanism provided on the first side of the package transfer arm, the package holding mechanism having package supplying means for supporting a plurality of packages and for simultaneously supplying the plurality of packages to a corresponding plurality of pegs of the creel bogie at a first time;

an empty take-up tube holding mechanism provided on the second side of the package transfer arm, the empty take-up tube holding mechanism having empty take-up tube receiving means for simultaneously receiving a plurality of empty take-up from a corresponding plurality of pegs of the creel bogie at a second time, the second time being a different time than the first time; and means for rotating the package transfer arm at least substantially 90°;

wherein the package holding mechanism includes a plurality of check members, each chuck member comprising a receiving element secured to the package transfer arm for supporting an outer peripheral surface of a yarn layer of a package and a pair of movable chucks for preseeing and holding the outer periphery of the package, said receiving element being formed from a curved plate; and wherein said chuck members are provided lengthwise of the package transfer arm with a pitch equal to a pitch between pegs on the side of the creel bogie and the movable chucks of each chuck member is operated by a first operating rod being slidably moved along the package transfer arm by a first fluid cylinder.

7. An apparatus for supplying a plurality of packages to and receiving a plurality of take-up tubes from pegs of a creel bogie, the apparatus comprising:

a movable bogie;

means for moving the movable bogie;

a lift supported by the bogie;

lift moving means for moving the lift with respect to the bogie;

a package transfer arm supported by the lift, said package transfer arm having a first side and a second side, the second side being arranged substantially 90° with respect to the first side;

a package holding mechanism provided on the first side of the package transfer arm, the package holding mechanism having package supplying means for supporting a plurality of packages and for simultaneously supplying the plurality of packages to a corresponding plurality of pegs of the creel bogie at a first time;

an empty take-up tube holding mechanism provided on the second side of the package transfer arm, the empty take-up tube holding mechanism having empty take-up tube receiving means for simultaneously receiving a plurality of empty take-up from a corresponding plurality of pegs of the creel bogie at a second time, the second time being a different time than the first time; and means for rotating the package transfer arm at least substantially 90°;

wherein said empty take-up tube holding mechanism includes a plurality of empty take-up tube holding members which are also provided lengthwise of the package transfer arm with a pitch equal to a pitch between pegs of the creel bogie, and each of which comprises a fixed empty take-up tube receiving element and a movable chuck, said each movable chuck being operated by a second operating rod slidably moved along the package transfer arm by a second fluid cylinder.

8. An apparatus, operable with a creel bogie having pegs for supporting packages and take-up tubes, the apparatus for supplying a plurality of packages to and receiving a plurality of take-up tubes from the pegs of the creel bogie, the apparatus comprising:

a package transfer arm having a first side and a second side;

a package holding mechanism extending from the first side of the package transfer arm, the package holding mechanism having package supplying means for supporting a plurality of packages and for simultaneously supplying the plurality of packages to a corresponding plurality of pegs of the creel bogie at a first time;

a take-up tube holding mechanism extending from the second side of the package transfer arm, the take-up tube mechanism having empty take-up tube receiving means for simultaneously receiving a plurality of take-up tubes from a corresponding plurality of pegs of the creel bogie at a second time, the second time being a different time than the first time; and means for turning the transfer arm between a first position wherein the first side of the transfer arm is directed toward the creel bogie and a second position wherein the second side of the transfer arm is directed toward the creel bogie.

9. An apparatus as claimed in claim 8, further comprising a movable bogie movable toward and away from the creel bogie, wherein the package transfer arm is supported by the movable bogie.

10. An apparatus as claimed in claim 9, further comprising a lift means supported by the movable bogie for raising and lowering the package support arm.

11. An apparatus as claimed in claim 8, further comprising a movable bogie movable to a first bogie position adjacent the creel bogie, wherein the package holding mechanism comprises a package supplying means for supplying a package to a peg of the creel bogie upon the transfer arm being arranged in the first position and upon the movable bogie being in the first bogie position.

12. An apparatus as claimed in claim 8, further comprising a movable bogie movable to a first bogie position adjacent the creel bogie, wherein the take-up tube holding mechanism comprises a take-up tube receiving means for receiving a take-up tube from a peg of the creel bogie upon the transfer arm being arranged in the second position and upon the movable bogie being in the first bogie position.

13. An apparatus as claimed in claim 8, further comprising a movable bogie movable to a first bogie position adjacent the creel bogie, wherein the package holding mechanism comprises a package supplying means for supplying a package to a peg of the creel bogie upon the transfer arm being arranged in the first position and upon the movable bogie being in the first bogie position and, wherein the take-up tube holding mechanism comprises a take-up tube receiving means for receiving a take-up tube from a peg of the creel bogie upon the transfer arm being arranged in the second position and upon the movable bogie being in the first bogie position.

14. Apparatus as claimed in claim 8, wherein each package and each take-up tube is provided with a peg receiving aperture having a length in which a peg of the creel bogie is insertable, the creel bogie pegs each having a length at least as great as the length of each package aperture and each take-up tube aperture, whereby a creel bogie peg extends through substantially the entire length of the package aperture or the take-up tube aperture upon the package or take-up tube, respectively, being supported by the creel bogie peg, the package holding mechanism comprising package delivering means for delivering a package to a creel bogie and for engaging the creel bogie peg with the package aperture.

15. Apparatus as claimed in claim 8, wherein each package and each take-up tube is provided with a peg receiving aperture having a length in which a peg of the creel bogie is insertable, the creel bogie pegs each having a length at least as great as the length of each package aperture and each take-up tube aperture, whereby a creel bogie peg extends through substantially the entire length of the package aperture or the take-up tube aperture upon the package or take-up tube, respectively, being supported by the creel bogie peg, the take-up tube holding mechanism comprising take-up tube receiving means for receiving a take-up tube supported by a creel bogie peg.

16. Apparatus as claimed in claim 8, wherein each package and each take-up tube is provided with a peg receiving aperture having a length in which a peg of the creel bogie is insertable, the creel bogie pegs each having a length at least as great as the length of each package aperture and each take-up tube aperture, whereby a creel bogie peg extends through substantially the entire length of the package aperture or the take-up tube aperture upon the package or take-up tube, respectively, being supported by the creel bogie peg, the package holding mechanism comprising package delivering means for delivering a package to a creel bogie and for engaging the creel bogie peg with the package aperture, the take-up tube holding mechanism comprising take-up tube receiving means for receiving a take-up tube supported by a creel bogie peg.

17. An apparatus as claimed in claim 8, wherein the package holding mechanism has holding means for abutting and holding the outer peripheral surface of a package.

18. An apparatus as claimed in claim 8, wherein the take-up tube holding mechanism has holding means for abutting and holding the outer peripheral surface of a take-up tube.

* * * * *